US009579906B2

(12) United States Patent
Hollands et al.

(10) Patent No.: US 9,579,906 B2
(45) Date of Patent: Feb. 28, 2017

(54) HEAT EXCHANGE UNIT FOR A PRINTING SYSTEM

(75) Inventors: Peter J. Hollands, Baarlo (NL); Rick Walraven, Eindhoven (NL); Eddy J. A. Van De Gaar, Reuver (NL); Frederik G. Heeman, Venlo (NL); Cornelis P. M. Van Heijst, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 1606 days.

(21) Appl. No.: 12/289,156

(22) Filed: Oct. 21, 2008

(65) Prior Publication Data

US 2009/0116866 A1 May 7, 2009

Related U.S. Application Data

(63) Continuation of application No. PCT/EP2007/052003, filed on Mar. 2, 2007.

(30) Foreign Application Priority Data

Apr. 21, 2006 (EP) ..... 06112926

(51) Int. Cl.
*G03G 21/20* (2006.01)
*B41J 11/00* (2006.01)
(Continued)

(52) U.S. Cl.
CPC ..... *B41J 11/002* (2013.01); *G03G 15/1695* (2013.01); *G03G 15/2014* (2013.01);
(Continued)

(58) Field of Classification Search
CPC ..... G03G 15/1695; G03G 15/2014
(Continued)

(56) References Cited

U.S. PATENT DOCUMENTS 5,752,150 A 5/1998 Kato et al.
6,049,680 A 4/2000 Goris et al.
(Continued)

FOREIGN PATENT DOCUMENTS

DE 28 11 835 A1 9/1979
DE 2811835 A * 9/1979
(Continued)

OTHER PUBLICATIONS

Dunn et al., "Heat Pipes", translated by Zhou Haiyun on National Defense Publish., Feb. 28, 1982, pp. 6-7.

*Primary Examiner* — Jennifer Simmons
(74) *Attorney, Agent, or Firm* — Birch, Stewart, Kolasch & Birch, LLP

(57) ABSTRACT

A heat exchange unit and a printing system containing the heat exchange unit, including a heat exchange region, a first print media transport path configured for transporting in operation a first print medium from a supply through the heat exchange, the heat exchange unit further containing a stationary heat exchange member, having a first side facing said first print media transport path and a second opposite side facing said second print media transport path, wherein, in operation, the second print medium is at an elevated temperature with respect to the first print medium and wherein, the first and second print medium have a heat exchange contact in the heat exchange region.

6 Claims, 4 Drawing Sheets

(51) Int. Cl.
*G03G 15/16* (2006.01)
*G03G 15/20* (2006.01)

(52) U.S. Cl.
CPC ..... *G03G 21/20* (2013.01); *Y10T 428/30* (2015.01); *Y10T 428/31678* (2015.04)

(58) Field of Classification Search
USPC ..... 399/390, 405, 406; 101/487, 488, 419
See application file for complete search history.

(56) References Cited

U.S. PATENT DOCUMENTS

| | | | | |
|---|---|---|---|---|
| 6,089,703 | A | 7/2000 | Pearson | |
| 6,466,454 | B1 * | 10/2002 | Jitaru | 361/836 |
| 2004/0096250 | A1 | 5/2004 | Kito et al. | |
| 2005/0139096 | A1 * | 6/2005 | Lu et al. | 101/33 |

FOREIGN PATENT DOCUMENTS

| | | | |
|---|---|---|---|
| EP | 399794 | A2 * | 11/1990 |
| EP | 1 508 452 | A1 | 2/2005 |

* cited by examiner

HEAT EXCHANGE UNIT FOR A PRINTING SYSTEM

This application is a Continuation of copending PCT International Application No. PCT/EP/2007/052003 filed Mar. 2, 2007, which designated the United States, and on which priority is claimed under 35 U.S.C. §120, and which application further claims priority under 35 U.S.C. §119(a) on Patent Application No. 06112926.8 filed in Europe on Apr. 21, 2006, the entire contents of each application being incorporated by reference.

BACKGROUND OF THE INVENTION

The present invention relates to a heat exchange unit and a printing system, comprising such a heat exchange unit. In particular the present invention is directed to a printing systems wherein an image of marking material is transferred from an image-bearing member onto a print media.

Printing systems wherein an image of marking material is formed on an image-bearing member and subsequently transferred and fused, possibly simultaneously, onto a print media are commonly used. Fusing an image of marking material onto a print media is executed under elevated pressure and temperature. The elevated temperature of the fuse apparatus is used to at least partially melt the marking material. This process is very power consuming. To enable a productive use of the fuse apparatus, a print media is often pre-conditioned. In particular, the temperature of the print media that enters into the fuse apparatus should not result in cooling the fuse apparatus down too much. Therefore it is common practise to use a pre-heater apparatus to condition the print media before the image of marking material is fused thereon. This process of pre-conditioning also consumes a significant amount of energy.

A disadvantage of this kind of printing system is that it consumes a large amount of energy. In particular, the pre-heating of the print media and the fusing process contribute to a high overall energy dissipation.

SUMMARY OF THE INVENTION

It is an object of the present invention to lower the total power dissipation. To this end, a printing system is provided, comprising a heat exchange unit, comprising a heat exchange region, a first print media transport path configured for transporting in operation a first print medium from a supply through the heat exchange region to a print engine and a second print media transport path configured for transporting in operation a second print medium from the print engine through the heat exchange region, the heat exchange unit further comprising a stationary heat exchange member, having a first side facing said first print media transport path and a second opposite side facing said second print media transport path, wherein in operation, the second print medium is at an elevated temperature with respect to the first print medium and wherein the first and second print medium have a heat exchange contact in the heat exchange region.

A printing system comprising a heat exchange unit according to the present invention is able to use the energy that is dissipated into the printing system in a more efficient way, as the thermal energy that is transferred into the print media is reused before the printed media is ejected from the printing system. Therefore the energy dissipation of the pre-heater apparatus can be lowered or even diminished, while the productivity of the fuse apparatus is not degraded.

A further advantage of a printing system comprising a heat exchange unit according to the present invention is the reduction of the need for a cooling system for cooling the printer media before ejecting. As the printed media and the fused image of marking material are at an elevated temperature when they leave the print engine, the printed media, in particular the marking material on the printed media have to be cooled down to a temperature at which it is fixed to the paper and the stickiness of the marking material is reduced. Otherwise the marking material on a first printed media could stick to a printed media that is consecutively placed on top of said first printed media. The heat exchange unit cools the outgoing printed media down by donating a part of the thermal energy that is applied to the printed media to the heat exchange unit.

Cool print media that is separated from a supply typically has a temperature of about 20° C. Printed media that is ejected from a print engine are typically at a temperature of about 60° C. to 110° C.

A further advantage of a printing system comprising a heat exchange unit according to the present invention is the decurling effect of the heat exchange unit on the print media. A printed media that is fed through the heat exchange unit has a significant decrease in the amount of media curl when compared to the situation which does not utilize a heat exchange unit. The first print media transport path of the heat exchange unit is at close proximity with respect to said second print media transport path in at least a part of the heat exchange region. This close proximity of said paths enables a more efficient thermal energy exchange between a printed media at elevated temperature and a print media that is transported into the print engine.

A printing system having a heat exchange unit is further known from U.S. Pat. No. 6,089,703. This describes an inkjet printer including a paper transport assembly with a plurality of rolls defining an approach path and a return path connected by a heated central roll. It is a disadvantage of such a system that the heat exchange is implemented via a rotating roll. This heat exchange is therefore not energy efficient.

Offenlegungsschrift DE 28 11 835 A1 describes a paper transport path along which a fixing unit is positioned. A separate heat exchange unit is placed to stretch from a position before to a position after the fixing unit. Heat exchange between these positions is not energy efficient.

In an embodiment of the heat exchange unit according to the present invention, the first print media transport path extends contiguous to the second print media transport path. By arranging the first and second print media transport paths contiguous to each other, having only the heat exchange member disposed therebetween, the heat exchange between the first and second print media transport paths is very efficient.

In an embodiment of the heat exchange unit according to the present invention, said first and second print media transport path are configured such that, in an operative state, direct contact is avoided between said first and second print media in at least a part of the heat exchange region. By means of avoiding direct contact, which means that the first and second print media do not touch each other directly inside the heat exchange unit, the risk of smearing of the marking material and pollution with dust is reduced.

In a further embodiment of the heat exchange unit according to the present invention, a heat exchange member is arranged between said first and second print media transport paths, such that direct contact between said first and second print media is avoided.

The heat exchange member introduces additional freedom with respect to the timing of print media in the heat exchange region. When the heat exchange unit comprise an open connection between said first and second print media transport paths, the leading edges of the first and second print media can collide with each other when the timing is not correct. By avoiding direct contact, this risk of collision is avoided and additional freedom of timing is introduced.

In a further embodiment of the heat exchange unit according to the present invention, the separating member is a flexible foil. A thin, flexible foil improves the heat exchanging contact between printed media at elevated temperature and cooler print media as a separating member between the print media can deform enough to follow the form of both print media. Decreasing the distance between the print media at elevated temperature and the cooler print media improves the heat exchange, and additionally ensure a more homogenous special temperature elevation by the buffering of thermal energy. All elements that are placed between said first and second print media transport paths and have a physical contact with the print media should have low friction with respect to the print media, such that it does not disturb the transport movement of the print media. The elements that form the boundary between said first and second print media can therefore be supplied with a smooth coating, e.g., polytetrafluoroethylene (PTFE) or Ultra High Molecular Weight Polyethylene (UHMWPE). To prevent problems with static charging of print media that are transported while sliding along an electrically isolating surface, the surface can be completely or partially supplied with electrically conducting elements to drain any (electrostatic) charges. Also, surfaces that experience contact with the print media should have resistance to wear and release the print media when required.

In another further embodiment of the heat exchange unit according to the present invention, the heat exchange member is a heat transporting member which includes means for circulating a heat transporting fluid through the heat transporting member.

This heat transport member receives thermal energy from the print media at elevated temperature and efficiently transports it towards the print media in the first print media transport path.

In another embodiment of the heat exchange unit according to the invention, wherein said first and second print media transport path are configured such that, in an operative state, said first print media is transported in a direction opposite to the direction of said second print media in said heat exchanging region. Transporting the print media at elevated temperature in a direction opposite to the direction of transport of the colder print media introduces a counter flow heat exchange process. A counter flow heat exchange process gains a more efficient heat exchange process with respect to a parallel flow heat exchange process. Where, in a parallel flow heat exchange process, the maximum and minimum temperatures for the respective cold and print media at elevated temperature are limited by the mean initial temperature of the print media at elevated temperature and cool print media, the respective exit temperatures of print media in a counter flow heat exchange process are limited by the initial temperatures of the print media in the opposite print media transport paths. Therefore a counter flow heat exchange unit gains a more efficient heat exchange process.

In another embodiment according to the present invention, the heat exchange unit further comprises pressing means capable of applying pressure on the print media in the second print media transport path in the direction of the first print media transport path. By applying pressure on the print media in the second print media transport path in the direction of the first print media transport path, the gap between print media in the respective first and second print media transport paths decreases. This yields a more efficient heat exchange process. The pressing means can, for example, comprise an elastic foam member, a silicone element, a pressurised airbag, pressurized cushions, a mechanical device containing springs, pneumatics or the like. Typically the pressure force on the print media in the direction of the first print media transport path is relatively low with respect to the driving force on the print media in the direction of transport through the print media transport paths. The pressure that is applied to the second print media transport path can be set to depend on the properties of the print media, such as stiffness or weight. A very flexible thin print media, such as 50 gr/m$^2$ rice paper sheets can then be pressed down more gently such that it will not ripple inside the heat exchange unit.

In another embodiment according to the present invention, the heat exchange unit further comprises a print media guiding member, rotatably positioned adjacent to the exit of any of said first and second print media transport paths, radially extending into the print media transport path. Especially when the exit of the print media transport paths are shaped in a curved fashion, the stress on the print media and the image can increase significantly. Applying freely rotatable members adjacent to the curvature decreases the stress on the print media and the shear stress on the image of marking material and thereby decreases the risk of smearing the marking material. The rotatable member can comprise a wheel that is rotatably connected to the heat exchange unit with the use of a bearing.

In another embodiment according to the present invention, the heat exchange unit further comprises a heat transport element for transporting heat in operation by vaporising a fluid at a hot area of the heat transport element having an elevated temperature, condensing the vapor at an area of the heat transport element having a lower temperature with respect to said hot area and transporting the condensed fluid back to the hot area.

This heat transport member increases the effective heat exchanging length of the heat exchange unit by transporting thermal energy from outside the heat exchange region into the heat exchange region. This heat transport member transports thermal energy in a known way, as used in heat pipes for electronics. For instance the heat transport element extends from the input side of the second print media transport path towards the first print media transport path. This implementation of a heat transport element yields an additional heat exchanging length of the heat exchange unit while the maximum pinch distance does not need to be increased. The distance between the push pinch and the drawing pinch which respectively push and draw the print media forward in the print media transport paths determine the minimum dimensions of the print media that can be handled. Using a heat transport element that extends from the input side of the second print media transport path towards the first print media transport path effectively adds extra heat exchange length without degrading the minimum media dimensions that can be handled.

In another embodiment according to the present invention, the heat exchange unit comprises a heater element that is positioned adjacent to the first print media transport path in said heat exchange region. This heater element can temporarily contribute an additional amount of thermal energy, for example when no print media at elevated temperature is available, e.g., during a start-up procedure, or after an interruption of print activity. This extra amount of thermal energy can contribute in flattening the input temperature profile of print media in the print engine.

In another embodiment according to the present invention, the heat exchange unit is surrounded at least partially by a thermally isolating element. This thermally isolating element contributes to a more efficient energy balance for the surrounded area. The thermal energy is restrained within the thermally isolating element such that it can be transferred to the cold print media in the first print media transport path.

BRIEF DESCRIPTION OF THE DRAWINGS

The present invention will now be explained with reference to the following drawings, wherein.

DETAILED DESCRIPTION OF THE INVENTION

Figure 1:
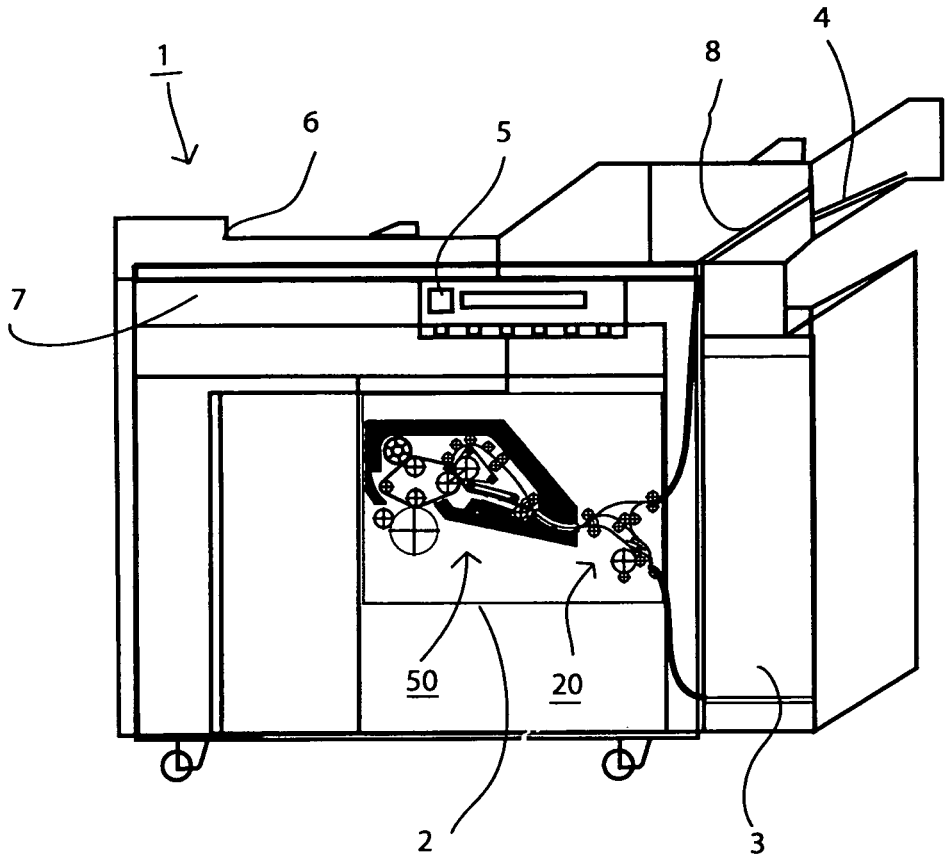
FIG. 1 is a schematic view showing a printing system comprising a heat exchange unit according to an embodiment of the present invention.
Figure 2:
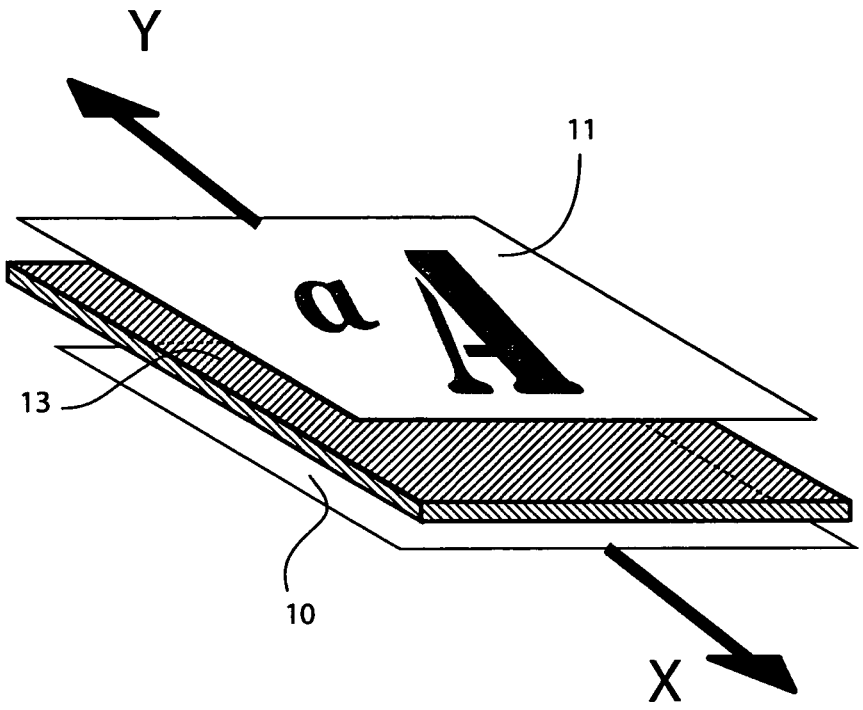
FIG. 2 is a schematic view of the heat exchange process according to an embodiment of the present invention.

FIG. 1 shows a schematic view showing a printing system comprising a heat exchange unit according to an embodiment of the present invention. The printing system 1 has an engine 2 into which the paper is fed from a supply 3, preconditioned and printed with a printing process 50 and fed to a take-out area from which an operator can remove the printed media. The printing system 1 delivers marking material onto the print media in an image-wise fashion. This image can be fed, e.g., by a computer via a wired or wireless network connection (not shown) or by means of a scanner 7. The scanner 7 scans an image that is fed into the automatic document feeder 6 and delivers the digitized image to the printing controller (not shown). This controller translates the digital image information into control signals that enable the controller to control the marking units that deliver marking material onto an intermediate member. A preheated print medium is fed along the intermediate member, from which the image-wise marking material image is transferred onto the print medium. This marking material image is fused onto the print medium in a fuse step under elevated pressure and temperatures. The image bearing print medium is cooled down to a lower temperature before the print medium is delivered to the take-out area 4. A user-interface 5 enables the operator to program the print job properties and preferences such as the choice for the print medium, print medium orientation and finishing options. The printing system 1 has a plurality of finishing options such as stacking, saddle stitching and stapling. The finishing unit 8 executes these finishing operations when selected. It will be clear to a person skilled in the art that other image forming processes wherein an image of marking material is transferred onto a print media, possibly via one or more intermediate members, e.g., electro(photo)graphic, magnetographic, inkjet, and direct imaging processes are also applicable. The print media 11 that are delivered from the print process 50 are at an elevated temperature because of heating in the print process 50 and heating in the fusing step. The heat exchange unit according to the present invention uses the thermal energy of these outgoing print media for the preheating of cold media that have to be preheated before entering the print process 50. The outgoing printed media 11 are transported through a heat exchange zone in the heat exchange unit 20. FIG. 2 shows a schematic view of this principle. A print medium 10 that is separated from a supply unit 3 is transported to the print process 50 in the direction marked with arrow X. The thermal energy of the printed media 11 that originates from the print process and the fuse step is donated to the cold print media 10 through a thermal intermediate 13. While cooling the printed medium 11 down to an acceptable temperature in which the marking material is hardened and therefore less sensitive to smearing, the printed medium 11 is transported in the direction marked with arrow Y towards the take-out area 4 of the printing system 1.

Figure 3:
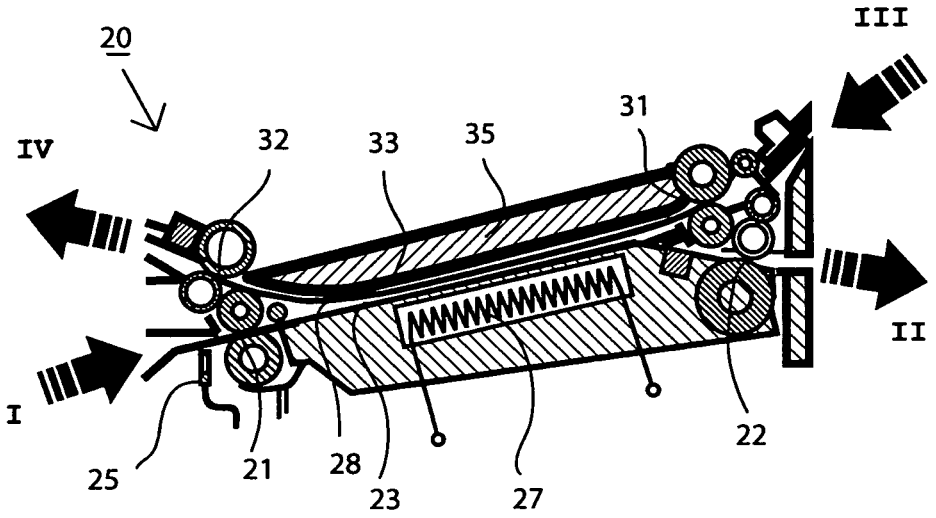
FIG. 3 is a schematic view of a heat exchange unit according to an embodiment of the present invention.

FIG. 3 is a schematic view of a heat exchange unit according to an embodiment of the present invention. A print medium is separated from a supply unit 3 and fed into the first print media transport path 23 of the heat exchange unit 20 in the direction of arrow I. This entry into the heat exchange unit is registered by sensor 25. The print medium is moved into pinch 21, which pushes the print medium through the first print media transport path 23 towards pinch 22. Pinch 22 draws the print medium from area 23 towards the print process (not shown) in the direction of arrow II. Inside the print process the print medium is pre-heated by an electric pre-heater (not shown) to facilitate the image-wise application of marking material which is fused into the print medium under elevated pressure and temperature. Both the application of the marking material and the fusing of the marking material onto the print medium increase the temperature of the print medium. The print medium at elevated temperature is then removed from the print process and fed into the second print media transport path 33 of the heat exchange unit in the direction of arrow III. Pinch 31 pushes the print media from the print process towards pinch 32. While the print media at elevated temperature is transported through the second print media transport path 33 a second print media is fed into the first print media transport path 23. As the first and second print media transport paths 23, 33 are having a heat exchange contact, the first print media at elevated temperature in the second print media transport path partially donates its thermal energy to the second print media in the first print media transport path 23 which receives the thermal energy and heats up. Because the first print medium donates thermal energy to the second print medium, the pre-heater of the print process can lower its thermal dissipation.

In case of the absence of a print medium at an elevated temperature, e.g., at system start-up or after an interruption of print-activity, the heater element 27 can correct for the absence of the extra thermal energy as long as no print media at elevated temperature is available.

To improve the exchange of thermal energy between print media at elevated temperature in the second print media transport path 33 and the cold media in the first print media transport path 23 a pressing member 35 applies pressure on the print media at elevated temperature such that the heat exchange efficiency increases. This pressure is sufficiently high to increase the heat exchange efficiency and sufficiently low as not to disturb the passage of the print media too much. Pressing member 35 is a foam layer that applies approximately 100-200 Pa of pressure on the print media. The heat exchange member begin stationary, i.e., the member does not move relative to the print media in the print media transport path, increases the efficiency of the heat exchange.

To decrease the risk of smearing and cross-pollution of marking material from one print medium onto the other, a thin and flexible foil 28 is applied in between said first and second print media transport paths 23, 33. This thin flexible foil 28 is very smooth such that the print media are not obstructed while they are transported through the print media transport paths 23, 33. To prevent static charging of the print media the foil 28 has electro-conductive properties. The foil 28 is resistant to wear and has a low sliding resistance. To improve the thermal behavior of the foil 28 during the heat exchange between a first and a second print medium the foil is constructed very thin, such that the heating of the foil 28 itself does not obstruct the heat exchange between the print media. Therefore the heat capacity and thermal resistivity of the foil are adapted to exchange the heat between the first and second print media.

Figure 4B:
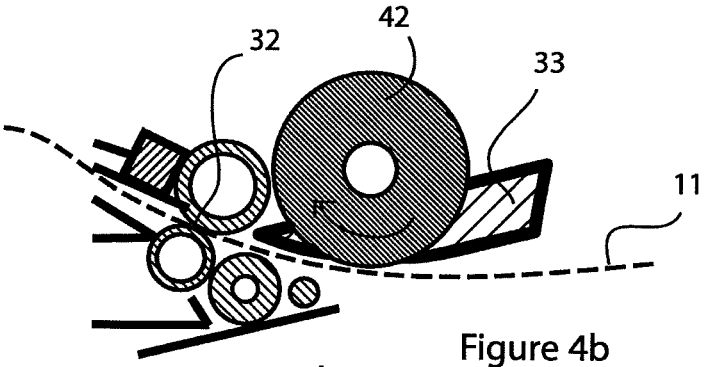
FIGS. 4*a* and 4*b* are schematic views of a heat exchange unit comprising rotatable guiding members according to an embodiment of the present invention.
Figure 4A:
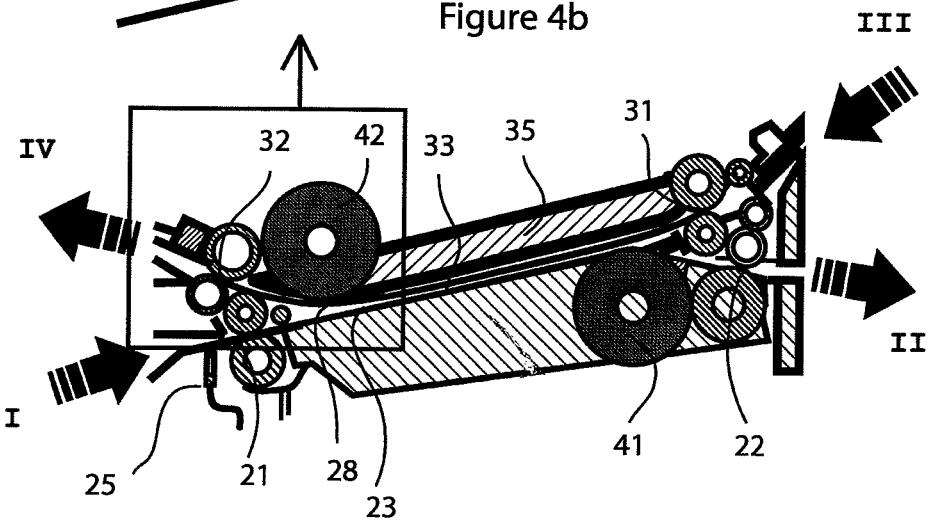

FIGS. 4*a* and 4*b* show schematic views of a heat exchange unit comprising rotatable guiding members according to an embodiment of the present invention. The boxed area of FIG. 4*a* is enlarged and depicted in FIG. 4*b*. At the exits of the print media transport paths 23, 33 guiding members 41, 42 are rotatably connected with the heat exchange unit. Print media 11 that are transported through the paper paths 23, 33 are initially pushed respectively by pinches 21 and 31 until the print media are fed into drawing pinches 22 and 32. These drawing pinches 22 and 32 draw the print media out of the print media transport paths 23 and 33. Because the print media inside of the print media transport paths 23, 33 are influenced by a certain amount of friction, this drawing out of the print media 11 will put stress on the print media when drawn out. Especially at the curved exit areas of the print media transport paths 23, 33, this stress can occur. The freely rotatable guide members 41 and 42 decrease the stress on the print media 11 at these areas, thereby decreasing the risk of affecting the print media and image integrity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A heat exchange unit, comprising:

a heat exchange region;

a first print media transport path configured for operatively transporting a first print medium from a supply through the heat exchange region to a print engine;

a second print media transport path configured for operatively transporting a second print medium from the print engine through the heat exchange region;

a stationary heat exchange member in the form of a flexible foil having a first side facing said first print media transport path and a second, opposite side facing said second print media transport path, wherein, in operation, the second print medium conveyed from the print engine is at an elevated temperature with respect to the first print medium conveyed from the supply and wherein the first and second print medium are placed in heat exchange communication in the heat exchange region; and a pressing device configured to apply pressure to the second print medium in the second print media transport path in the direction of the first print media transport path such that the flexible foil deforms in order to follow the form of the first and second print media.

2. The heat exchange unit according to claim 1, wherein said first and second print media transport paths are configured such that, in an operative state in the heat exchanging region, said first print media is transported in a direction opposite to the direction of said second print media.

3. The heat exchange unit according to claim 1, wherein the first and second print media transport paths define a print media transport path, wherein a rotatable print media guiding member, positioned adjacent to the exit of any of said first and second print media transport paths, extends radially into the print media transport path.

4. The heat exchange unit according to claim 1, wherein a heater element is positioned adjacent to said first print media transport path in said heat exchange region.

5. The heat exchange unit according to claim 1, wherein the first media transport path extends contiguous to the second print media transport path.

6. A printing system in which a cold print medium is introduced from a supply in a first print media transport path, to a printing process and removed from said printing process as a print medium of elevated temperature, defining a second print media transport path, said first print media transport path extending contiguous to the second print media transport path, said printing system comprising:

a heat exchange unit providing heat exchange communication between the cold print medium and the print medium having said elevated temperature, said heat exchange unit including a flexible foil having a first side facing said first print media transport path and a second, opposite, side facing said second print media transport path, whereby the thermal energy of the print medium having the elevated temperature is transferred to the cold print medium to preheat the cold print medium, and resulting in the cooling of the print medium of elevated temperature;

a pressing device configured to apply pressure to the second print medium in the second print media transport path in the direction of the first print media transport path such that the flexible foil deforms in order to follow the form of both print media.

* * * * *